United States Patent [19]

Shustov

[11] Patent Number: 4,974,378

[45] Date of Patent: Dec. 4, 1990

[54] SEISMIC-ISOLATOR

[76] Inventor: Valentin N. Shustov, 536¾N. Genesee Ave., Los Angeles, Calif. 90036

[21] Appl. No.: 459,260

[22] Filed: Dec. 29, 1989

[51] Int. Cl.[5] ..... E02D 27/34; E04B 1/98; E04H 9/02

[52] U.S. Cl. ..... 52/167 R; 248/638; 52/167 CB

[58] Field of Search ..... 52/167 R, 167 CB, 167 DF; 248/638

[56] References Cited

U.S. PATENT DOCUMENTS

| | | | |
|---|---|---|---|
| 896,431 | 8/1908 | Boermel | 52/167 R |
| 1,651,411 | 12/1927 | Porter | 52/167 R |
| 2,014,643 | 9/1935 | Bakker | 52/167 R X |
| 2,208,872 | 7/1940 | Ropp | 52/167 R |
| 2,359,036 | 9/1944 | Harper | 52/167 R X |
| 3,425,652 | 2/1969 | Leary | 248/638 X |
| 4,496,130 | 1/1985 | Toyama | 52/167 R X |
| 4,883,250 | 11/1989 | Yano et al. | 248/638 |

FOREIGN PATENT DOCUMENTS

| | | | |
|---|---|---|---|
| 666266 | 6/1979 | U.S.S.R. | 52/167 |
| 903546 | 2/1982 | U.S.S.R. | 52/167 |

*Primary Examiner*—Richard E. Chilcot, Jr.
*Assistant Examiner*—Deborah McGann Ripley

[57] ABSTRACT

A manufacture to isolate a structure from earthquake motion of a hazardous magnitude and at the same time to secure its stability under strongest possible wind, which comprises:

(a) a number of ball transfer units rigidly coupled to a supported superstructure;

(b) the same number of pedestal plates, each having a concave upper surface with an extra central depression following the shape of the ball.

The force of gravity will keep the structure in its steady initial position when the balls are inset into corresponding depressions at any wind pressure and at slight earthquakes. With magnitude of earth movement exceeding a certain threshold the balls get out of central depressions, any transfer of horizontal movement to the superstructure dramatically decreases, and hazardous shaking of the earth cannot damage the structure.

1 Claim, 1 Drawing Sheet

SEISMIC-ISOLATOR

BACKGROUND OF THE INVENTION

1. Field of the Invention

The present invention relates to earthquake base isolation of buildings and other structures. More particularly, the invention relates to antifriction base isolators.

2. Description of the Prior Art

It is considered to be the ultimate in seismic isolation to place a superstructure on roller or ball bearings. In this case, almost no horizontal force will be transmitted in a superstructure. However, extreme yieldingness under wind load and inability to restore the initial position prevented such systems from practical implementation.

The invention entitled "Earthquake Shelter" (Ser. No 07/363,592, U.S. Patent Allowed) incorporates ball bearing base isolator where the ball bearing is supported on a pedestal plate having a concave upper surface; the ball bearing permits the superstructure to remain horizontally undisturbed during an earthquake and retains its initial position with respect to the footing. But this system is not intended for resistance against wind.

The invention entitled "Earthquake Stable Support" (SU-666-266) has a sphere contained between two belts with conical recesses, each side having additional recess in its center to remain the sphere in position under wind pressure. But the conical shape of the recesses makes the system auto-tuning with the earth excitation, because the growth of the ground period is accompanied by the increase in ground displacement which in its turn gives rise to the increase of the isolated system period, and the system has to perform under periresonant conditions. Besides, functioning of a support of this kind is associated with travelling the sphere horizontally regarding the supported superstructure which generates alternating eccentrically applied vertical base reactions that might result in excitation of damaging flextural stress waves.

SUMMARY OF THE INVENTION

To minimize the transmission of destructive ground motion into a superstructure, to prevent permanent horizontal post-earthquake offsets and at the same time to keep the system's ability to withstand wind pressure, as well as minor earthquakes, a seismic isolator is offered which consists of a ball transfer unit raggedly constructed and rigidly connected to the supported superstructure. The ball rests on a depression which is shaped in compliance with the configuration of the contacting surface of the ball and is centered at the lowest point of the pedestal plate having a concave upper surface and resting on a foundation.

BRIEF DESCRIPTION OF THE DRAWINGS

In the description of the invention herein presented, references are made to the accompanying drawings, in which.

DESCRIPTION OF THE PREFERRED EMBODIMENT

Figure 1:
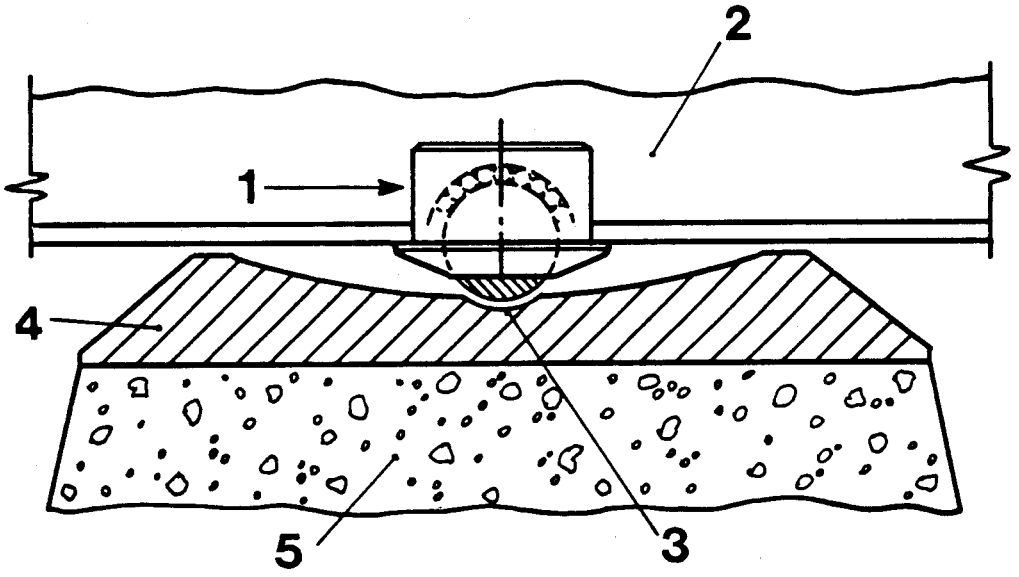
FIG. 1 is a schematic perspective of a seismic isolator with associated superstructure and foundation.
Figure 2:
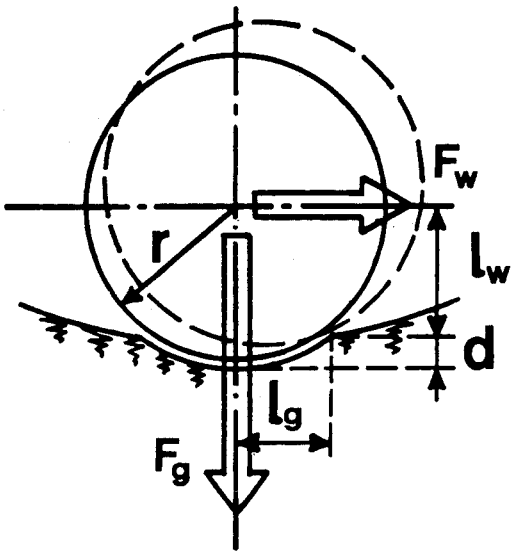
FIG. 2 is an enlarged vertical elevation of the ball, depression and adjoining part of the pedestal plate with a pattern of acting forces.

The present invention will be described with reference to the accompanying drawings. As illustrated at FIG. 1 the seismic isolator according to the invention has a ball transfer unit (1) which consists of a large ball that supports the superstructure (2) and permits the foundation to move horizontally not involving the superstructure in this movement. The large ball is positioned in a massive steel housing which is located above the ball and is coupled rigidly to the superstructure in order to ensure irreversible foot reactions and to prevent an induction of secondary waves of flexure in bearing elements of the superstructure. The large ball is separated from the housing by several smaller balls running in a hemispheric shell (conventional practice, The large ball rests on a depression (3) of a pedestal plate (4). The depression is shaped in compliance with the configuration of the contacting surface of the ball and is centered at the lowest point of the pedestal plate having a concave upper surface and resting on a foundation (5) to which it is firmly attached. The depth of the depression d at given radius of the ball r is governed mainly by weight of the structure $F_g$ and by design wind load $F_w$ (FIG. 2). For most of structures with the exception of slender ones such as high-rises, tall chimneys and open-frame towers, the maximum wind load averages a relatively small fraction of a strong earthquake base shear. Therefore, the force of gravity will keep the structure in a steady position on the pedestal plate both at any wind and at slight earthquakes. When magnitude of the earth movement exceeds a certain threshold the ball gets out of the depression, any transfer of horizontal movement to the superstructure practically gets ceased, and a hazardous shaking of the foundation does not influence the superstructure.

The upper surface of the pedestal plate (4) is shaped as a spherical segment to ensure an independence of the natural period of the isolated structure from the foundation amplitude and thus to prevent the structure against auto-tuning to periresonant frequencies. The chord (horizontal diameter of the cavity) is equal or more than the double maximum amplitude of any possible vibration of the ground during a strong earthquake. The radius of vertical curvature of the upper surface of the pedestal plate is designed as big as to provide a proper tuning-out the natural frequencies of base-isolated from fixed-base structure.

WHAT IS CLAIMED IS:

1. A system of seismic base isolation devices adapted to separate a superstructure from a foundation for protection against damaging effect of strong earthquakes and at the same time to prevent a separation under wind loads or minor earthquakes, each of said devices comprising:

a ball transfer unit consisting of a large ball positioned in a massive steel housing, said housing located above said ball and connected rigidly to a supported superstructure, said ball separated from said housing by several smaller balls running in a hemispheric shell;

a pedestal plate attached to a foundation and supporting said ball transfer unit being in rollable contact with a concave upper surface of said pedestal plate during horizontal vibration of said foundation, the geometry of said upper surface of said pedestal plate being governed by correlation of natural periods of vibration of isolated and fixedbase structures, as well as by maximum credible earthquake displacement;

an additional depression in the center of said pedestal plate forming a contacting surface following the shape of said ball, the geometry of said depression at given radius of said ball being governed by interrelation between design wind load and weight of the structure in supposition that said ball remains in said depression retaining integrity of the superstructure with the foundation under wind loads or minor earthquakes, but wheels out of said depression permitting relative movement of the foundation with respect to the superstructure during earthquakes of moderate to strong magnitude.

* * * * *